US010443272B2

(12) United States Patent
Lai

(10) Patent No.: US 10,443,272 B2
(45) Date of Patent: Oct. 15, 2019

(54) DUAL UNLOCKING MODE PADLOCK

(71) Applicant: THE SUN LOCK COMPANY, LTD., Tuen Mun, N. T. (HK)

(72) Inventor: Karl Lai, Tai Po (HK)

(73) Assignee: The Sun Lock Company, Ltd., Tuen Mun, N.T. (HK)

( * ) Notice: Subject to any disclaimer, the term of this patent is extended or adjusted under 35 U.S.C. 154(b) by 76 days.

(21) Appl. No.: 15/889,364

(22) Filed: Feb. 6, 2018

(65) Prior Publication Data

US 2018/0320416 A1 Nov. 8, 2018

Related U.S. Application Data

(60) Provisional application No. 62/501,274, filed on May 4, 2017.

(51) Int. Cl.
*E05B 67/00* (2006.01)
*E05B 67/24* (2006.01)
(Continued)

(52) U.S. Cl.
CPC ..... *E05B 67/24* (2013.01); *E05B 35/105* (2013.01); *E05B 37/0034* (2013.01);
(Continued)

(58) Field of Classification Search
CPC .... E05B 35/00; E05B 35/105; E05B 35/0034; E05B 35/0068; E05B 35/025;
(Continued)

(56) References Cited

U.S. PATENT DOCUMENTS 1,653,254 A 12/1927 Chisholm
1,728,902 A 9/1929 Cohen
(Continued)

FOREIGN PATENT DOCUMENTS

CN 101315007 12/2008
CN 201372636 12/2009
(Continued)

OTHER PUBLICATIONS

Combined Search and Examination Report issued by the GB Intellectual Property Office dated Feb. 21, 2019 in counterpart GB application No. GB1815277.7 (6 pages).
(Continued)

*Primary Examiner* — Suzanne L Barrett
(74) *Attorney, Agent, or Firm* — Ware, Fressola, Maguire & Barber LLP

(57) ABSTRACT

A padlock has a shackle having a long leg and a short leg, and a spindle with an extended member, the extended member engaged with the long leg of the shackle for movement together. The padlock also has a cylinder to receive a key for key operation, a stack of clutches and a plurality of dials engageable with the clutches to form a combination code, each clutch having an opening to receive the spindle. When the padlock is unlocked by the combination code, the spindle is engaged with the clutch stack for movement together along with the shackle. When the padlock is unlocked by the key operation, the spindle is disengaged with the clutch stack, allowing the spindle and the shackle to move upward relative to the clutch stack.

15 Claims, 7 Drawing Sheets

(51) Int. Cl.
*E05B 37/02* (2006.01)
*E05B 37/00* (2006.01)
*E05B 35/10* (2006.01)
*E05B 65/52* (2006.01)

(52) U.S. Cl.
CPC ..... *E05B 37/0068* (2013.01); *E05B 37/025* (2013.01); *E05B 65/52* (2013.01)

(58) Field of Classification Search
CPC ..... E05B 67/00; E05B 67/24; E05B 65/00; E05B 65/52; E05B 37/22
USPC ..... 70/21, 25, 284, 285
See application file for complete search history.

(56) References Cited

U.S. PATENT DOCUMENTS

| | | | | |
|---|---|---|---|---|
| 4,444,029 | A | 4/1984 | Remington | |
| 4,733,548 | A | 3/1988 | Ling | |
| 4,829,794 | A | 5/1989 | Crown | |
| 5,715,709 | A | 2/1998 | Lai | |
| 5,953,940 | A | 9/1999 | Ling | |
| 6,029,481 | A | 2/2000 | Lai | |
| 6,176,109 | B1 | 1/2001 | Tsui | |
| 6,474,116 | B1 | 11/2002 | Lai | |
| 6,675,614 | B2 | 1/2004 | Lai | |
| 6,729,166 | B1 | 5/2004 | Lai | |
| 6,883,355 | B2 | 4/2005 | Lai | |
| 6,904,776 | B1 | 6/2005 | Lin | |
| 7,117,698 | B2 | 10/2006 | Lai | |
| 7,121,123 | B2 | 10/2006 | Yu | |
| 7,140,209 | B2 | 11/2006 | Lai | |
| 7,155,944 | B1 | 1/2007 | Lin | |
| 7,225,648 | B2 | 6/2007 | Lai et al. | |
| 7,370,498 | B1 | 5/2008 | Miao | |
| 7,467,531 | B2 | 12/2008 | Lai et al. | |
| 7,523,628 | B2 * | 4/2009 | Yu | E05B 37/0034 70/21 |
| 7,562,545 | B2 | 7/2009 | Lai et al. | |
| 7,685,851 | B2 | 3/2010 | Lai | |
| 7,765,840 | B2 | 8/2010 | Lai et al. | |
| 8,261,583 | B2 | 9/2012 | Lai et al. | |
| 8,511,118 | B2 | 8/2013 | Lai et al. | |
| 8,661,861 | B2 | 3/2014 | Lai | |
| 8,776,556 | B2 | 7/2014 | Lai | |
| 8,881,558 | B2 | 11/2014 | Misner et al. | |
| 8,919,155 | B2 | 12/2014 | Lai | |
| 8,931,313 | B2 | 1/2015 | Lai | |
| 8,966,946 | B2 | 3/2015 | Lai | |
| 9,206,625 | B2 | 12/2015 | Lai | |
| 9,556,650 | B1 | 1/2017 | Lai | |
| 2003/0150245 | A1 | 8/2003 | Lai | |
| 2004/0031298 | A1 | 2/2004 | Lai | |
| 2005/0092036 | A1 | 5/2005 | Lai | |
| 2006/0027000 | A1 | 2/2006 | Yu | |
| 2006/0027001 | A1 | 2/2006 | Lai | |
| 2006/0150690 | A1 | 7/2006 | Lai et al. | |
| 2006/0243005 | A1 | 11/2006 | Lai et al. | |
| 2006/0260369 | A1 | 11/2006 | Lai et al. | |
| 2008/0011025 | A1 | 1/2008 | Lin | |
| 2008/0083251 | A1 | 4/2008 | Lai et al. | |
| 2008/0098774 | A1 | 5/2008 | Huang | |
| 2008/0196459 | A1 | 8/2008 | Yu | |
| 2008/0250825 | A1 | 10/2008 | Lai | |
| 2009/0113947 | A1 | 5/2009 | Lai et al. | |
| 2012/0304711 | A1 | 12/2012 | Misner et al. | |
| 2013/0025333 | A1 | 1/2013 | Lai | |
| 2013/0036778 | A1 | 2/2013 | Lai | |
| 2013/0118215 | A1 | 5/2013 | Lai | |
| 2014/0026626 | A1 | 1/2014 | Lai | |
| 2014/0250952 | A1 | 9/2014 | Lai | |
| 2014/0352371 | A1 | 12/2014 | Lai | |
| 2014/0366592 | A1 | 12/2014 | Bao et al. | |
| 2014/0373579 | A1 | 12/2014 | Lai | |
| 2015/0322692 | A1 * | 11/2015 | Lai | E05B 37/14 70/21 |
| 2015/0330104 | A1 | 11/2015 | Lai | |
| 2017/0009488 | A1 * | 1/2017 | Lai | E05B 37/0058 |

FOREIGN PATENT DOCUMENTS

| | | |
|---|---|---|
| CN | 104141423 | 11/2014 |
| EP | 1837466 | 9/2007 |
| EP | 2738326 | 6/2014 |
| GB | 203929 | 9/1923 |
| GB | 2493266 | 1/2013 |
| GB | 2498242 | 7/2013 |
| GB | 2519128 | 4/2015 |
| JP | 07305553 | 11/1995 |
| JP | 2011168983 | 9/2011 |
| TW | M247658 | 10/2004 |
| WO | 2006016280 | 2/2006 |
| WO | 2015170226 | 11/2015 |

OTHER PUBLICATIONS

Search Report issued by the GB Intellectual Property Office dated Mar. 15, 2016 in counterpart GB application No. GB1516376.9 (1 page).
Examination Report issued by the GB Intellectual Property Office dated Mar. 15, 2016 in counterpart GB application No. GB1516376.9 (4 pages).
International Search Report dated Oct. 12, 2015 in counterpart international application No. PCT/IB2015/053122 (4 pages).
Search Report issued by the EP Patent Office dated May 30, 2017 in counterpart EP application No. EP16176160.6 (7 pages).

* cited by examiner

DUAL UNLOCKING MODE PADLOCK

CROSS REFERENCE TO RELATED PATENT APPLICATION

This patent application claims benefit to U.S. Provisional Application No. 62/501,274, filed May 4, 2017, which is hereby incorporated by reference.

TECHNICAL FIELD

The present invention relates to a padlock having a dual locking system.

BACKGROUND OF THE INVENTION

The current market has many Transportation Security Administration ("TSA") luggage locks that are able to let a TSA agent open the lock with an overriding key mechanism. The benefits of this approach include that the lock does not need to be cut open by a TSA agent if inspection of the luggage is desired.

SUMMARY OF THE DISCLOSURE

The present invention provides a padlock that has a shackle with a long leg and a short leg, and a spindle with an extended member, wherein the extended member is engaged with the long leg of the shackle for movement together.

Thus, it is an aspect of the present invention to provide a padlock which is operable in a locked mode, an opened mode and a reset mode, the padlock comprising:

a shackle comprising a heel and a toe, a lock body comprising a first side, an opposing second side, a toe hole on the first side, the toe hole dimensioned to receive the toe, and a heel channel dimensioned for placement of the heel;

a spindle located inside the lock body, movable along a first direction substantially parallel to the heel channel, the spindle connected to the heel of the shackle for movement together in the first direction relative to the lock body;

a plurality of clutches arranged to form a clutch stack, each of the clutches having an opening dimensioned to receive the spindle;

a plurality of dials engageable with the plurality of clutches to form a combination code; and a cylinder arranged for a key operation, the cylinder having a cylinder wall arranged to contact the clutch stack when the padlock is operated in the locked mode, the opened mode and the reset mode, wherein the lock body further comprises a cylinder hole located on the second side of the lock body and a body chamber located near the cylinder hole, the cylinder hole dimensioned to receive the cylinder so as to allow the cylinder to move along the first direction, the body chamber dimensioned for placement of the clutch stack, and wherein the padlock can be unlocked to change from the locked mode to the opened mode by the combination code or by the key operation, and wherein, wherein, when the padlock is unlocked by the combination code, the spindle is engaged with the clutch stack for movement together along the first direction, and wherein, wherein, when the padlock is unlocked by the key operation, the spindle is disengaged from the clutch stack, allowing the spindle to move in the first direction relative to the clutch stack.

According to an embodiment of the present invention, each of the dials is arranged to engage with a different one of the clutches to form a dial-clutch pair, and each of the clutches comprises a cylindrical surface and a plurality of protrusions around the cylindrical surface, and each of the dials comprises a plurality of teeth dimensioned to receive the protrusions of the clutch in the dial-clutch pair, wherein when the padlock is operated in the locked mode and in the opened mode, the teeth of the dial are arranged to engage with the protrusions of the clutch in the dial-clutch pair, preventing the dial from rotation relative to the clutch in the dial-clutch pair.

According to an embodiment of the present invention, the body chamber comprises a plurality of blocking edges, each blocking edge corresponding to a different one of the clutches, and wherein each of the clutches further comprises an opening slot on the cylindrical surface, the opening slot dimensioned to receive the corresponding blocking edge, wherein when the opening slot is misaligned with the blocking edge, the clutch is prevented from moving in the first direction, and when the padlock is unlocked by the combination codes, the opening slot of each of the clutches is aligned with the corresponding blocking edge, allowing the clutch stack to move in the first direction along with the spindle to change the padlock from the unlocked mode to the opened mode.

According to an embodiment of the present invention, the spindle comprises a first spindle end and an opposing second spindle end, the first spindle end adjacent to the first side of the lock body, the spindle further comprising an extended member at the first spindle end, the extended member connected to the heel of the shackle for the movement together in the first direction, while allowing the heel to rotate in the heel chamber relative to the extended member.

According to an embodiment of the present invention, the spindle further comprises a spindle protrusion at the second spindle end, the spindle protrusion arranged to engage with the cylinder for causing the clutch stack to move together with the spindle and the cylinder in the first direction when the padlock is unlocked by the combination code, and when the padlock is unlocked by the key operation, the spindle protrusion is disengaged from the cylinder, allowing the spindle to move in the first direction relative to the clutch stack.

According to an embodiment of the present invention, when the padlock is operated in the locked mode, the toe of the shackle is engaged with the toe hole of the lock body, preventing the heel of the shackle from rotating relative to the lock body, and when the spindle is moved in the first direction toward the first side of the lock body together with the heel of the shackle to change the padlock from the locked mode to the opened mode, the toe of the shackle is disengaged from the toe hole of the lock body, allowing the shackle to rotate relative to the lock body.

According to an embodiment of the present invention, the heel channel comprises a passage slot and a reset slot on the first side of the lock body, and the heel of the shackle comprises a reset notch located near the first side of the lock body, wherein when the padlock is operated in the locked mode, the reset notch is located inside the lock body between the passage slot and the extended member of the spindle, and when the padlock is unlocked by the combination code or by the key operation, the heel of the shackle can be caused to move in the first direction and the reset notch is moved through the passage slot to locate outside the lock body to change the padlock from the locked mode to the opened mode.

According to an embodiment of the present invention, when the padlock is operated in the opened mode and the reset notch of the heel is aligned with the passage slot of the heel chamber, the shackle can be caused to move in a second direction opposite to the first direction to engage the toe of the shackle with the toe hole for changing the padlock from the opened mode to the locked mode.

According to an embodiment of the present invention, the cylindrical surface of each of the clutches has a surface portion for disposing the plurality of protrusions, wherein when the padlock is operated in the locked mode and in the opened mode, each of the dials is located adjacent to the surface portion of the clutch in the dial-clutch pair and the teeth of each of the dials are engaged with the protrusions of the clutch in the dial-clutch pair, and wherein when the padlock is operated in the opened mode and the shackle has been rotated to cause the reset notch on the heel to align with the reset slot of the heel chamber, the shackle can be caused to move together with the spindle, the clutch stack and the cylinder in a second direction opposite to the first direction for relocating each of the dials away from the surface portion of the clutch in the dial-clutch pair so as to disengage the teeth from the protrusions in the dial-clutch pair.

According to an embodiment of the present invention, when the teeth of the dial in each of the dial-clutch pairs is disengaged with the protrusion of the clutch in each of the dial-clutch pairs, the dial can be rotated relative to the clutch in the dial-clutch pair for changing the combination code.

According to an embodiment of the present invention, the cylinder comprises a first cylinder end and an opposing second cylinder end, the second cylinder located near the second side of the lock body, the first cylinder end comprising the cylinder wall and a tip extended from the cylinder wall, the tip arranged to engage with the spindle protrusion when the padlock is operated in the locked mode, wherein the cylinder further comprises a key slot at the second cylinder end, the key slot dimensioned to receive a key to rotate the cylinder in the cylinder hole relative to the lock body so as to disengage the tip from the spindle to unlock the padlock by the key operation.

According to an embodiment of the present invention, the cylinder further comprises a pointer and the cylinder hole comprises an edge-groove arranged to receive the pointer for rotation therein when the cylinder is caused to rotate relative to the lock body.

According to an embodiment of the present invention, the cylinder hole further comprises a track in communication with the edge-groove, the track arranged to receive the pointer when the cylinder is caused to move in the first direction along with the spindle when the padlock is unlocked by the combination code to change the padlock from the locked mode to the opened mode and wherein when the pointer is located in the track, the cylinder is prevented from rotation relative to the lock body.

According to an embodiment of the present invention, the padlock further comprises a latch and an indicator member, the latch having a latch opening and a latch fork adjacent to the latch opening, the indicator member having an indicator end and a cutout section positioned in relationship to the latch, and the lock body further comprises a latch slot and an indicator chamber, the latch slot made in the cylinder hole, the indicator chamber dimensioned for placement of the indicator member, the indicator chamber having a chamber hole extended to the second side of the lock body, wherein when the padlock is operated in the locked mode, the cutout section of the latch is located in the latch fork, preventing the indicator end from moving outside the lock body through the chamber hole.

According to an embodiment of the present invention, when the cylinder is caused to rotate relative to the lock body to unlock the padlock by the key operation, the pointer is arranged to move the latch toward the indicator member, causing the cutout section of the indicator member to move out of the latch fork into the latch opening, wherein when the cutout section of the indicator member is moved out of the latch fork into the latch opening, the indicator end of the indicator member is allowed to move outside the lock body through the chamber hole.

The present invention will become apparent upon reading the description in conjunction with FIGS. 1A-17C.

DETAILED DESCRIPTION OF THE INVENTION

Figure 1A:
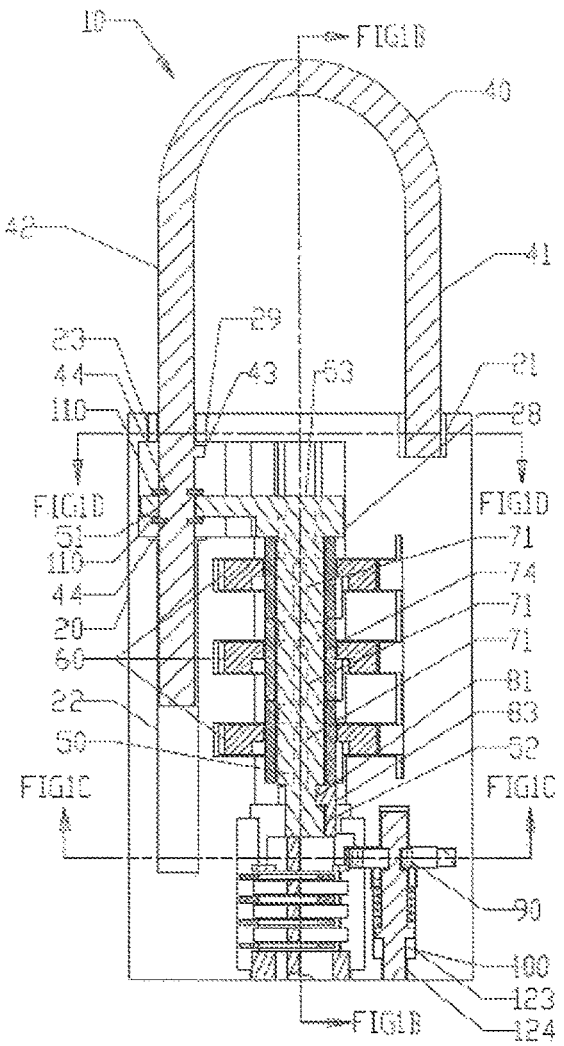
FIG. 1A is a cross-sectional front view of a padlock in the locked position, according to an embodiment of the present invention.

The present invention provides a padlock 10 which has a spindle 50 and a shackle 40 with a heel 42 and a toe 41. As seen in FIGS. 1A, 12A, 13A, 14A, 16A and 17A, the spindle 50 has an extended member 53 connected to the heel 42 of the shackle 40 for movement together in a first direction. The padlock 10 can be unlocked by a combination code or by a key operation. The padlock 10 has a stack of clutches 70 arranged such that, when the padlock 10 is unlocked by the combination code, the spindle 50 is engaged with the stack of clutches 70 for movement together along the first direction, and when the padlock 10 is unlocked by the key operation, the spindle 10 is disengaged with the stack of clutches 70, allowing the spindle to move in the first direction relative to the stack of clutches 70.

Locked Mode (FIGS. 1A-11)

As seen in FIGS. 1A-1D, the padlock 10 has a shackle 40 with a long leg or heel 42 and a short leg or toe 41; a spindle 50 with an extended member 53 on one end and a spindle protrusion 52 on the other end; a stack of clutches 70; a plurality of dials 60 and a cylinder 80. The stack of clutches 70 is sandwiched between the extended member 53 of the spindle 50 and the cylinder 80. The padlock 10 also has a lock body made from two halves 20 and 30. The lock body 20/30 has a toe hole 21/31 on the first side, a cylinder hole 25/35 on the second side of the lock body; a heel channel 22/32 and a body chamber 28/38. The toe hole 21/31 is dimensioned to receive the toe 41 and the heel channel 22/32 is dimensioned for placement of the heel 42, allowing the heel to move upward and downward in the heel channel 22/32. The cylinder hole 25/35 is dimensioned to receive the cylinder 80. The body chamber 28/38 is dimensioned for placement of the stack of clutches 70.

Figure 2:
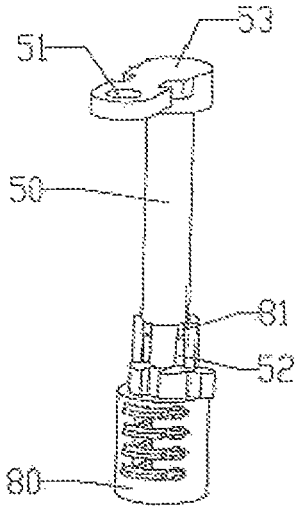
FIG. 2 is an isometric view of a spindle connected to a cylinder, according to an embodiment of the present invention.
Figure 6:
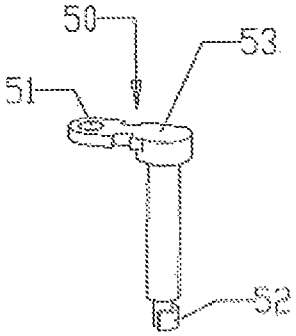
FIG. 6 is an isometric view of the spindle, according to an embodiment of the present invention.

As seen in FIGS. 2 and 6, the spindle 50 has an extended member 52 with a shackle-receiving-hole 51 on one end and a spindle protrusion 53 on the other end. The spindle protrusion 52 is arranged to engage with a tip 81 of the cylinder 80.

Figure 3:
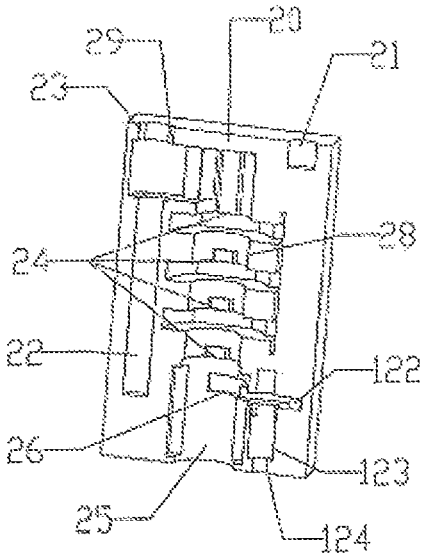
FIGS. 3 and 4 illustrate two halves of a lock body, according to an embodiment of the present invention.
Figure 4:
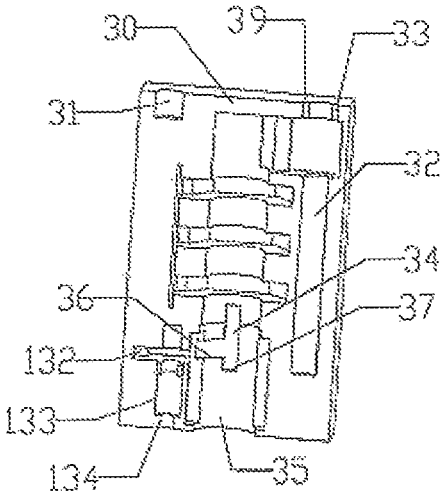

As seen in FIGS. 3 and 4, the lock body 20/30 is made from a first half 20 and a second half 30. These two parts, when consolidated, provide the toe hole 21/31, the heel channel 22/32, the cylinder hole 25/35 and the body chamber 28/38. The lock body 20/30 also comprises a reset slot 23/33 and a passage slot 29/39 on the first side of the lock body 20/30; an edge groove 26/36, a latch slot 122/132, an indicator chamber 123/133 with a chamber hole 124/134. The first half 20 also has a plurality of blocking edges 24 extended into the body chamber 28/38. The second half 30 also has a track 34 and a track-edge 37 both extended from the edge groove 26/36.

Figure 1B:
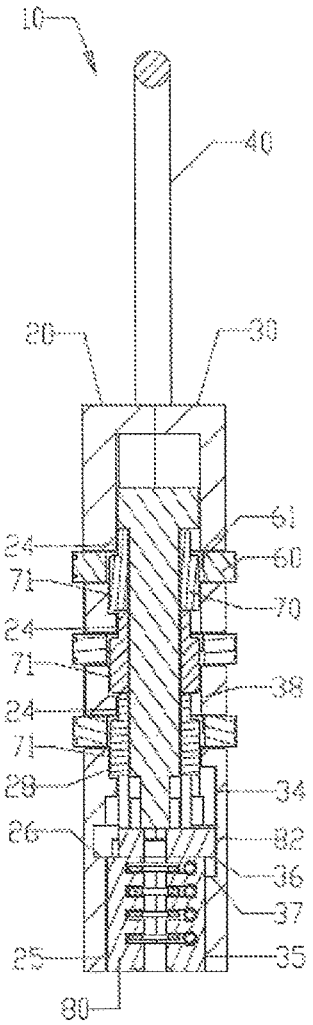
FIG. 1B is a cross-sectional side view of the padlock in the locked position, according to an embodiment of the present invention.
Figure 5:
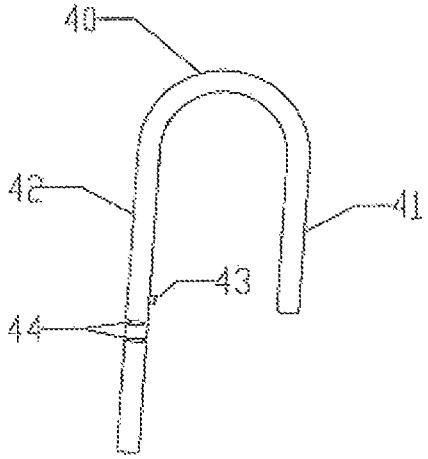
FIG. 5 is an isometric view of a shackle, according to an embodiment of the present invention.

As seen in FIG. 5, the shackle 40 has a reset notch 43 and two neck-area slots 44. The reset notch 43 is used to prevent the shackle 40 from moving downward when the padlock 10 is operated in the opened mode unless the reset notch 43 is aligned with the passage slot 29/39 as shown in FIG. 1D or aligned with the reset slot 23/33 in the reset mode (see FIG. 17A).

Figure 7:
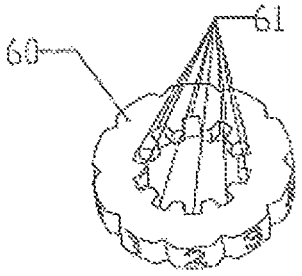
FIG. 7 is an isometric view of a dial, according to an embodiment of the present invention.

As seen in FIG. 7, the dial 60 has a plurality of indicia 62 on its outside surface and a plurality of teeth 61 on the inside surface.

Figure 8:
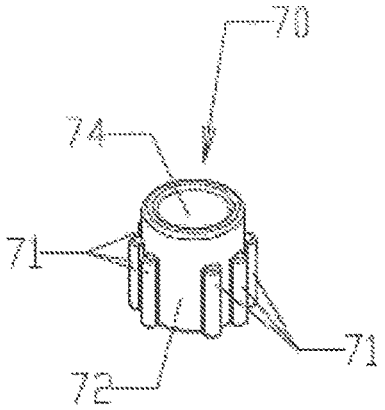
FIG. 8 is an isometric view of a clutch, according to an embodiment of the present invention.

As seen in FIG. 8, the clutch 70 has a plurality of protrusions 71 and an opening slot 72 on the lower part of its outer cylindrical surface. The clutch 70 also has an interior cylindrical surface defining a clutch opening 74 to receive the spindle 50 as indicated in FIG. 1B.

Figure 9:
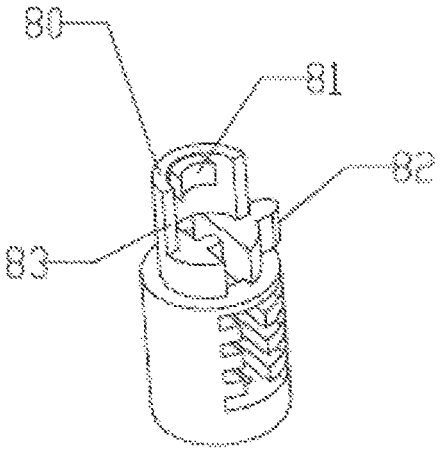
FIG. 9 is an isometric view of the cylinder, according to an embodiment of the present invention.

As seen in FIG. 9, the cylinder 80 has an upper end and a lower end. The upper end has a wall 83 and a tip 81 extended from the wall 83; and a pointer 82 below the wall 83. The lower end has a key slot arranged to receive a key 120 (see FIG. 13A, for example). The stack of clutches 70 is always in contact with the cylinder wall 83 of cylinder 80.

Figure 1C:
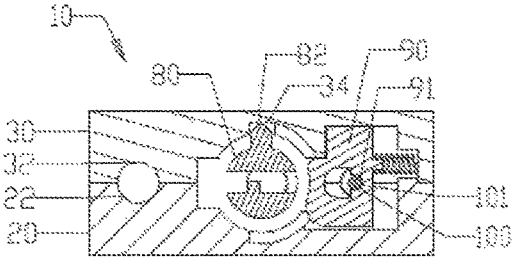
FIG. 1C is a cross-sectional bottom view of the padlock in the locked position, according to an embodiment of the present invention.
Figure 1D:
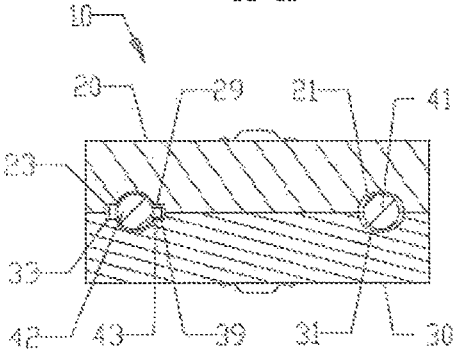
FIG. 1D is a cross-sectional top view of the padlock in the locked position, according to an embodiment of the present invention.
Figure 10:
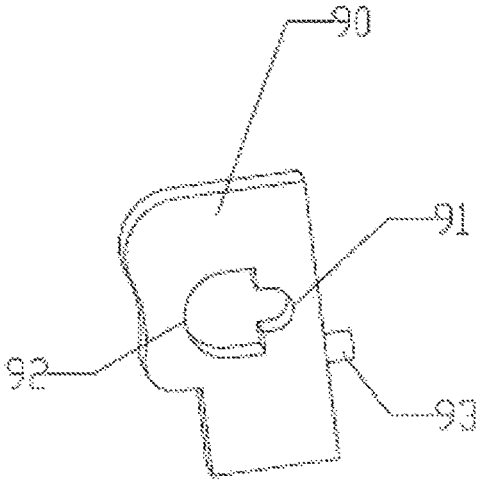
FIG. 10 is an isometric view of a latch, according to an embodiment of the present invention.

FIG. 10 illustrates a latch 90 having a latch opening 92, a fork 91 extended from the latch opening 92 and a latch spring support 93 for mounting a spring 99 as shown in FIG. 1C.

Figure 11:
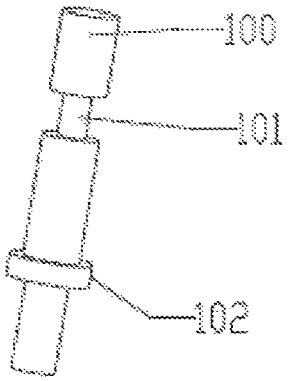
FIG. 11 is an isometric view of an indicator member, according to an embodiment of the present invention.

FIG. 11 illustrates an indicator member 100 having a cutout section 101 and a collar 102. The indicator member 100 is placed in the indicator chamber 123/133 as shown in FIG. 1A. When the padlock 10 is operated in the locked mode, the latch 90 is urged toward the cylinder 90 by the spring 99 as shown in FIG. 1C, and the cutout section 101 of the indicator member 100 is located in the fork 91 of the latch 90, preventing the indicator member 100 from moving downward.

According to the present invention, the wall 83 of the cylinder 80 is arranged to contact with the stack of clutches 70 and the spindle 50 is placed in the clutch opening 74 of each of the clutches 70. The shackle-receiving-hole 51 on the extended member 53 of the spindle 50 is dimensioned to receive the heel 42 of the shackle 40, allowing the shackle 40 to rotate relative to the lock body 20/30. The heel 42 is connected to the spindle 50 by two C-clips 110 inserted into the neck-area slots 44 so that a linear movement of the heel 42 along the heel channel 22/32 always transfers to the spindle 50. As the spindle protrusion 52 of spindle 50 is engaged with the tip 81 of cylinder 80, the upward or downward movement of spindle 50 also transfers to the cylinder 80. The dials 60 are arranged around the stack of clutches 70 to form a plurality of dial-clutch pairs. When the padlock is operated in the locked mode and the opened mode, the teeth 61 of each of the dials 60 are engaged with the protrusions 71 of the clutch 70 in a dial-clutch pair, preventing the dials 60 from rotating relative to the clutches 70. In other words, the rotational movement of each of the dials 60 transfers to the clutch 70 in the dial-clutch pair. According to an embodiment of the present invention, the blocking edges 24 in the body chamber 28/38 are positioned in relationship of the clutches 70 and the opening slot 72 on each of the clutches 70 is dimensioned to receive a corresponding blocking edge 24. Each of the blocking edges 24 is arranged to control the vertical movement of a corresponding clutch 70 such that only when the opening slot 72 on each of the clutches 70 is aligned with the corresponding blocking edge 24, the stack of the clutches 70 can move upward or downward relative to the lock body 20/30.

When the padlock 10 is operated in the locked mode, at least one of the clutches 70 is misaligned with the corresponding blocking edge 24. As such, the stack of clutches 70 that sits on top of the cylinder 80 prevents the cylinder 80 from moving upward. Furthermore, as the spindle 50 is engaged with the cylinder 80 and the heel 42 is connected to the spindle 50, the shackle 40 cannot be pulled upward to open the padlock. Moreover, without a key to engage with the cylinder 80 to unlock the padlock 10, the cylinder 80 does not rotate relative to the lock body 20/30.

Figure 12A:
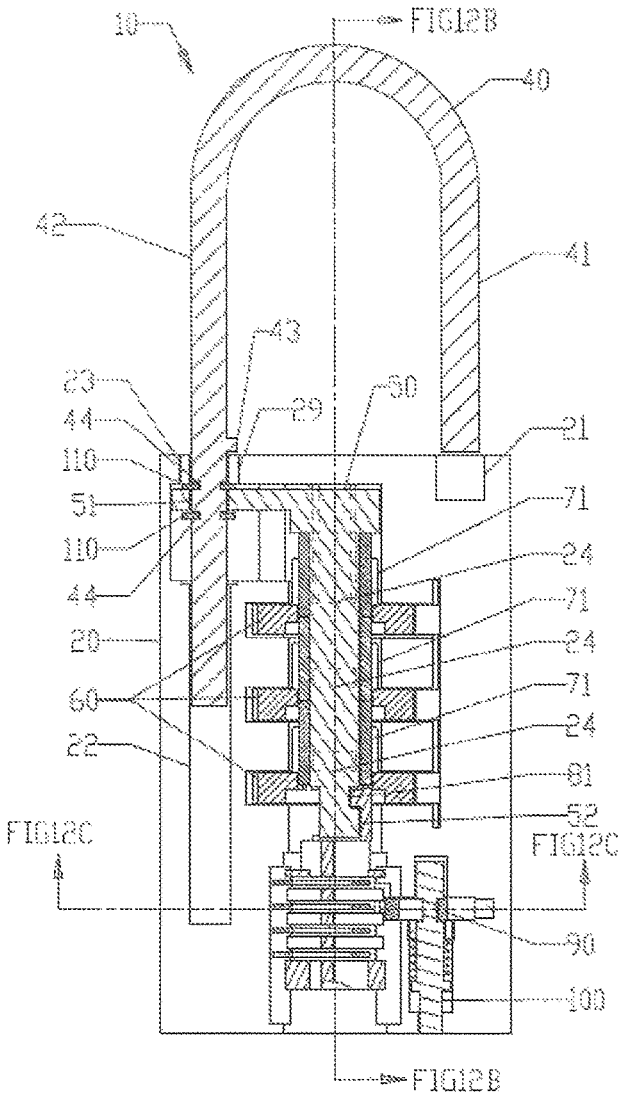
FIG. 12A is a cross-sectional front view of the padlock in the opened position, according to an embodiment of the present invention.

Unlocked by a Combination Code (FIGS. 12A-13)

According to an embodiment of the present invention, the indicia 62 of the plurality of dials 60 are used to form a combination code. When the padlock 10 is unlocked by the combination code, the dials 60 are rotated to cause the opening slots 72 on all the clutches 70 to align with the blocking edges 24 of the body chamber 28/38. Thus, the clutches 70 are not prevented by the blocking edges 24 from moving upward. As such, the shackle 40, together with the spindle 50, the clutches 70 and the cylinder 80, can be caused to move upward to release the toe 41 from the toe hole 21/31. Accordingly, each of the blocking edges 24 is received into the opening slot 72 of the corresponding clutch 70. While part of the heel 42 remains in the heel channel 22/32, the shackle 40 can be caused to rotate relative to the lock body 20/30 to change the padlock 10 from the unlocked mode to the opened mode. Even when the clutches 70 are caused to move upward, the teeth 61 of the dials 60 are still engaged with the protrusion 71 of the corresponding clutch 70. A rotating movement of the dial 60 transfers to the clutch 70 in the dial-clutch pair. However, because each of the blocking edges 24 is located inside the opening slot 72 of the corresponding clutch 70, all the dials 60, along with the clutches, are prevented from rotation relative to the lock body 20/30.

Figure 12B:
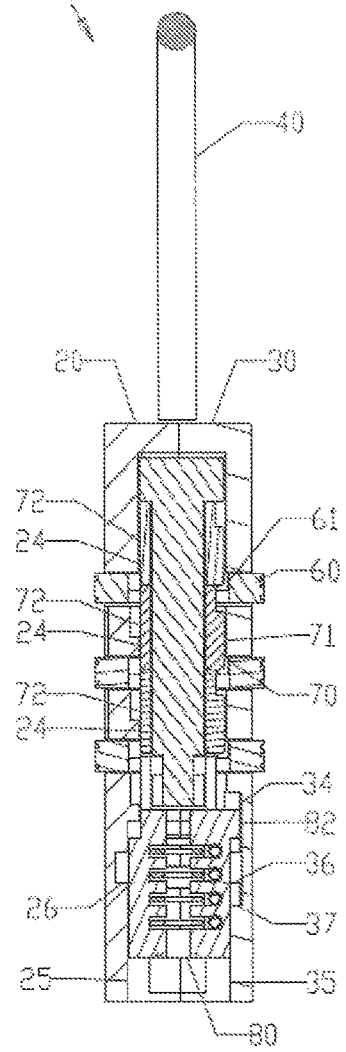
FIG. 12B is a cross-sectional side view of the padlock in the opened position, according to an embodiment of the present invention.
Figure 12C:
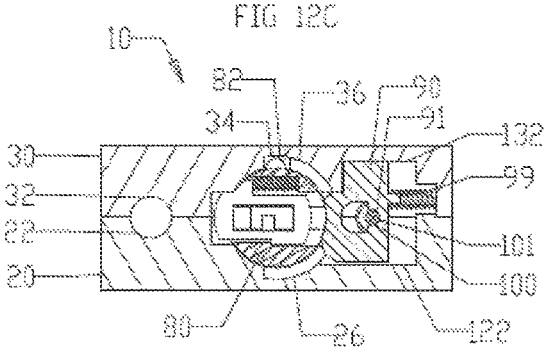
FIG. 12C is a cross-sectional bottom view of the padlock in the opened position, according to an embodiment of the present invention.

As the cylinder 80 is caused to move upward when the shackle 40 is pulled upward, the pointer 82 of the cylinder 80 is moved into the upper track 34 of the body chamber 28/38 as shown in FIG. 12C. The engagement between the pointer 82 and the upper track 34 prevents the cylinder 80 from rotation relative to the lock body 20/30. Thus, when the padlock 10 is unlocked by the combination code, the cylinder 80 cannot rotate even if a correct key 120 is used. Furthermore, because the cylinder 80 cannot rotate, the tip 81 of the cylinder 80 remains engaged with the spindle protrusion 52 of spindle 50, and the cylinder 80 cannot be separated from the lock body 20/30 as shown in FIG. 12A.

When the padlock 10 is unlocked by the combination code, the latch 90 is urged toward the cylinder 90 by the spring 99 as shown in FIG. 12C, and the cutout section 101 of the indicator member 100 is located in the fork 91 of the latch 90, preventing the indicator member 100 from moving downward.

Unlocked by Key Operation (FIGS. 14A-16D)

When the padlock 10 is operated in the locked mode, the stack of clutches 70 that sits on top of the cylinder 80 prevents the cylinder 80 from moving upward, and the shackle 40 is also prevented from moving upward.

Figure 13A:
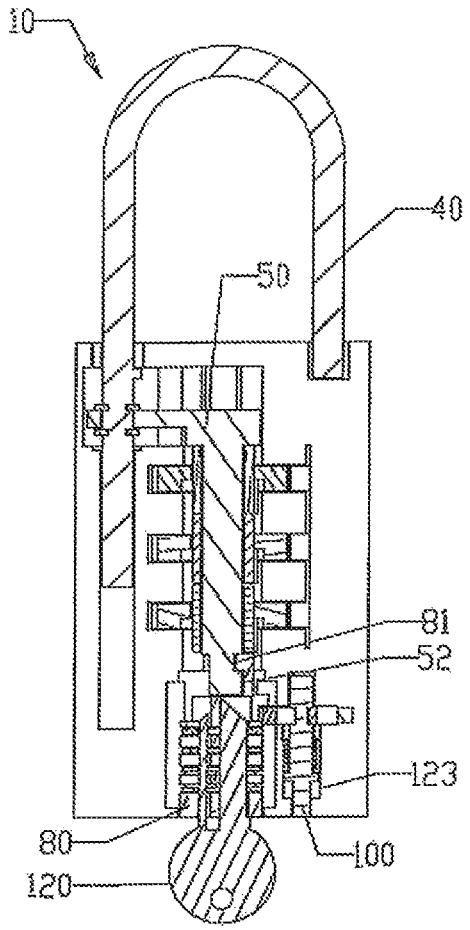
FIG. 13A is a cross-sectional front view of the padlock in the locked positioned with a key inserted into the cylinder, according to an embodiment of the present invention.
Figure 14A:
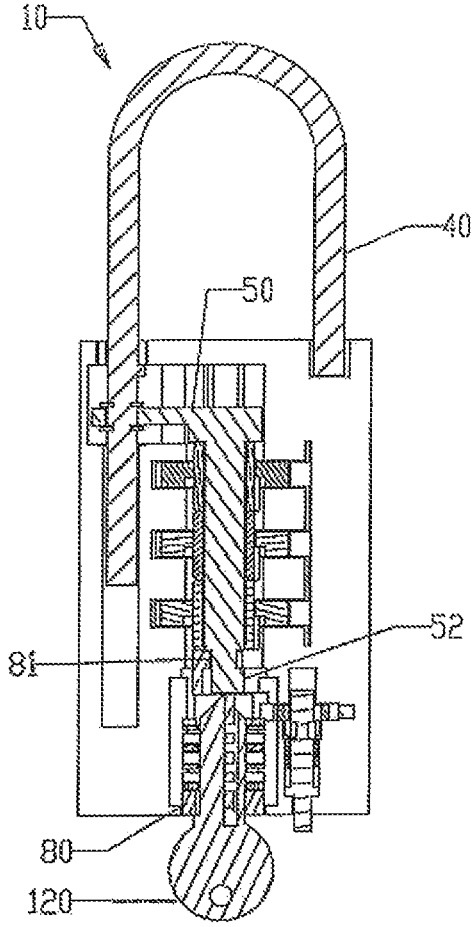
FIG. 14A is a cross-sectional front view of the padlock in the locked positioned with the cylinder being rotated 180 degrees by the key, according to an embodiment of the present invention.
Figure 13B:
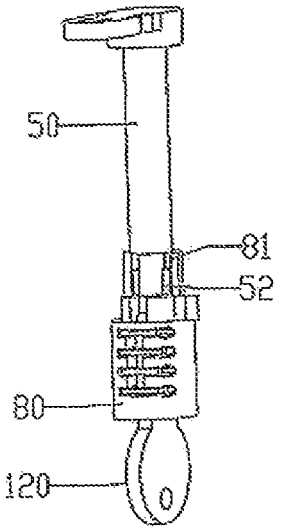
FIG. 13B is an isometric view of the spindle and the cylinder of FIG. 2 having the key inserted into the cylinder, according to an embodiment of the present invention.
Figure 14B:
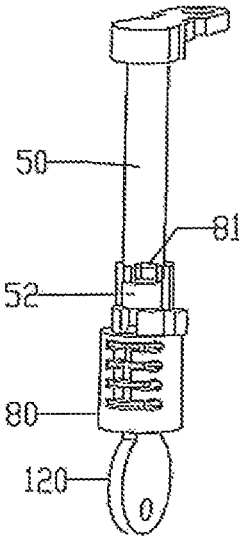
FIG. 14B is an isometric view of the spindle and the cylinder of FIG. 2 with the cylinder being rotated 180 degrees relative to the spindle, according to an embodiment of the present invention.
Figure 15:
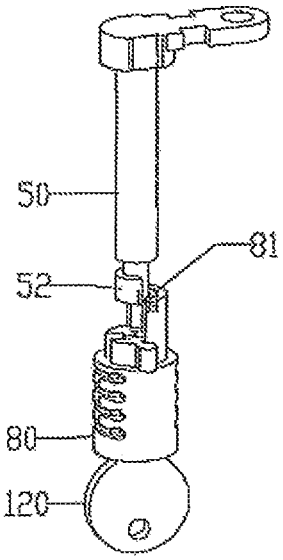
FIG. 15 is another isometric view of spindle and the cylinder of FIG. 14B, showing the relationship between the spindle protrusion of the spindle and the tip of the cylinder, according to an embodiment of the present invention.

If a correct key 120 is inserted into the cylinder 80 to unlock the padlock 10, the cylinder 80 can be rotated and the pointer 82 is moved along the edge groove 26 on the body chamber 28/38, away from the upper track 34 and the lower track 37. Because of the pointer 82 being located in the edge groove 26, the cylinder 80 cannot move upward or downward relative to the lock body 20/30. As the cylinder 80 is rotated, the stack of the clutches 70 remains in contact with the cylinder wall 83 of cylinder 80 and cannot move downward. Thus, the relative position between the clutches 70 and the dials 60 does not change. The teeth 61 of each of the dials 60 remain engaged with the protrusion 71 of clutch 70 in the dial-clutch pair. FIGS. 13A and 13B illustrate the padlock 10 in the locked mode and the relative position of the spindle 50 to the cylinder 80 when the key 120 has been inserted into the cylinder 80 but the cylinder 80 has not been rotated. As the cylinder 80 is rotated by the key 120, the pointer 82 contacts the latch 90 and pushes the latch 90 away from the cylinder 80, causing the cutout section 101 of indicator member 100 to move out of the fork 91 into the latch opening 92, and the indicator member 100 is urged to move downward by the spring 140. The downward of the indicator member 100 is stopped by the collar 102 at the chamber hole 124/134 and only the indicator tip 103 of indicator member 100 is located outside the lock body 20/30. However, the padlock 10 is still in the locked mode because the spindle protrusion 52 remains engaged with the tip 81 of cylinder 80 as shown in FIGS. 14A and 14B.

Figure 16A:
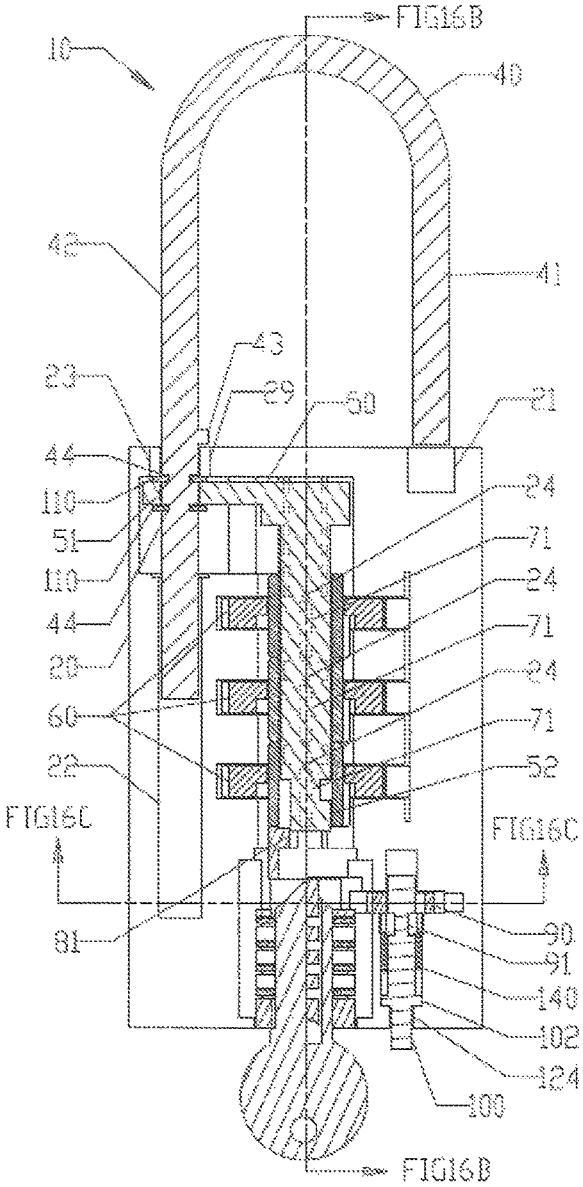
FIG. 16A is a cross-sectional front view of the padlock in the opened position unlocked by the key operation, according to an embodiment of the present invention.
Figure 16B:
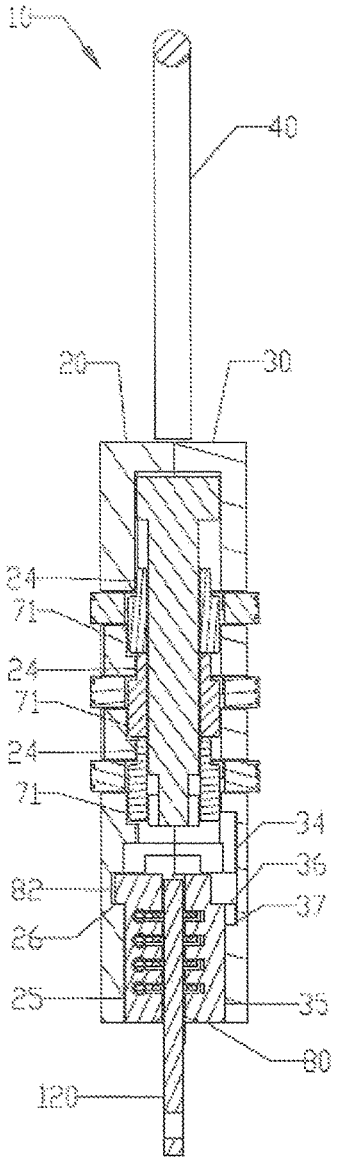
FIG. 16B is a cross-sectional side view of the padlock in the opened position unlocked by the key operation, according to an embodiment of the present invention.
Figure 16C:
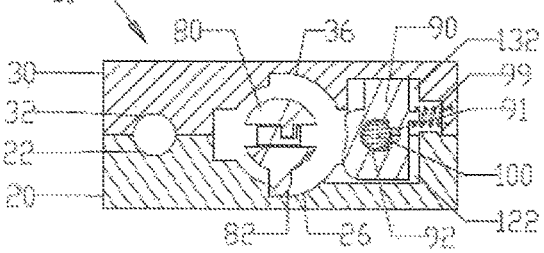
FIG. 16C is a cross-sectional bottom view of the padlock in the opened position unlocked by the key operation, according to an embodiment of the present invention.

Once the spindle protrusion 52 is disengaged from the tip 81 of cylinder 80, the shackle 40 can be pulled upward along with the spindle 50 to change the padlock 10 from the locked mode to the opened mode as shown in FIGS. 16A-16C. The indicator tip 103 serves as a reminder that the padlock 10 has been unlocked by the key operation.

It should be noted that, when the padlock 10 is operated in the opened mode as shown in FIGS. 12B and 16C, the reset notch 43 of the shackle 40 has moved through the passage slot 29/39 and is located outside the lock body 20/30. If the shackle 40 is rotated relative to the lock body 10, the shackle 40 cannot be pushed downward to change the padlock 10 from the opened mode to the locked mode unless the reset notch 43 is aligned with the passage slot 29/39. As such, when the padlock 10 is changed from the opened mode to the locked mode, the toe 41 is received into the toe hole 21/31 as shown in FIG. 1B. If the padlock 10 is unlocked by the combination mode, the spindle 50 remains engaged with the cylinder 50. But if the padlock 10 is unlocked by the key operation, the spindle 50 becomes disengaged from the cylinder 50. Thus, when the padlock 10 is re-locked, the cylinder 50 must be rotated back to its original position so as to engage the spindle protrusion 52 with the tip 81 of the cylinder 80.

Figure 17A:
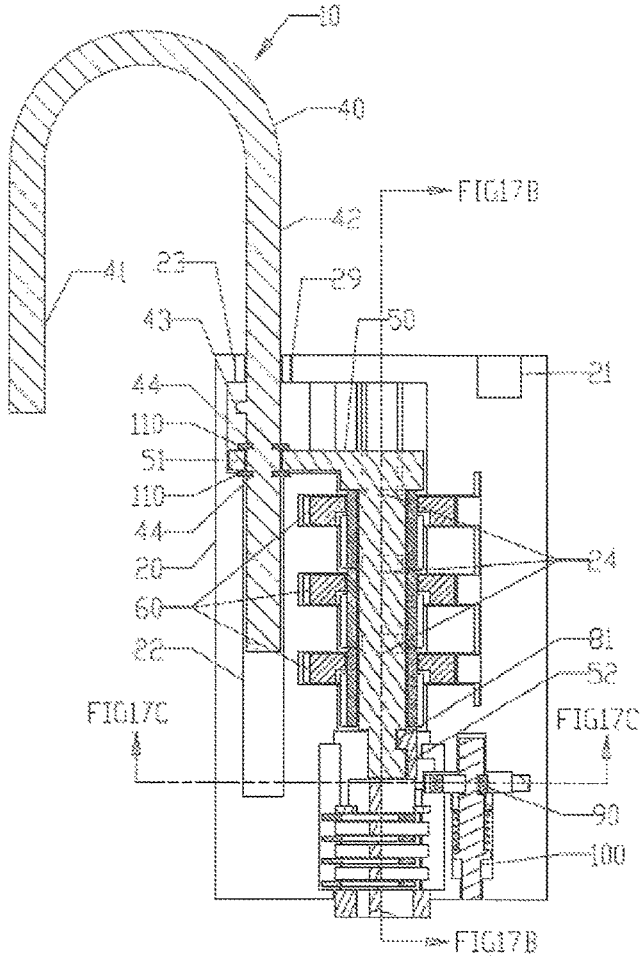
FIG. 17A is a cross-sectional front view of the padlock in the reset position, according to an embodiment of the present invention.
Figure 17B:
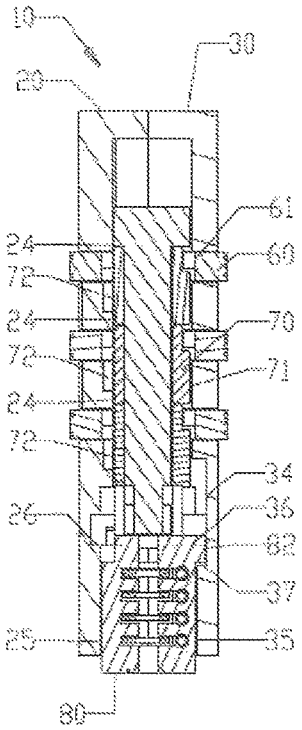
FIG. 17B is a cross-sectional side view of the padlock in the reset position, according to an embodiment of the present invention.
Figure 17C:
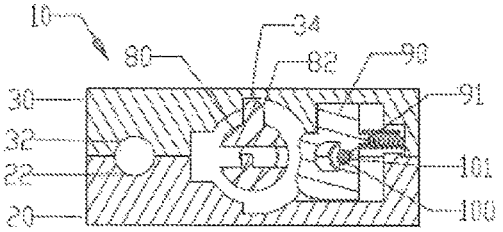
FIG. 17C is a cross-sectional bottom view of the padlock in the reset position, according to an embodiment of the present invention.

Reset Mode (FIGS. 17A-17C)

In order to change the combination code to reset the padlock 10, each of the dials 60 must be moved to the upper part of the clutch 70 in the dial-clutch pair so that the teeth 61 are disengaged from the protrusion 71. Thus, the clutches 70 are able to move further downward relative to the dials when the padlock 10 is operated in the opened mode.

When the padlock 10 is unlocked by the key operation to change to padlock 10 from the locked mode to the opened mode, the cylinder 80 cannot move upward or downward relative to the lock body 20/30 because the pointer 82 of cylinder 80 is located in the edge groove 26/36 of lock body 20/30. Furthermore, the clutches 70 cannot move further downward relative to the dials 60 to release the teeth 61 from the protrusion 71. Thus, when the padlock 10 is unlocked by the key operation, the padlock 10 cannot be reset.

When the padlock 10 is unlocked by the combination code, the opening slot 72 of each of the clutches 70 is aligned with the corresponding blocking edge 24 in the body chamber 20/30. Thus, when the padlock 10 is operated in the opened mode, the dials 60 cannot rotate relative to the lock body 20/30 but the clutches 70 can be caused to move downward. Furthermore, when the padlock 10 is unlocked by the combination code, the pointer 82 of cylinder 80 is located in the upper track 34 as shown in FIG. 12C. As the lower track 37 of lock body 20/30 is aligned with the upper track 34 as shown in FIG. 4, the cylinder 80 can be pushed downward such that the pointer 82 is moved into the lower track 37.

According to an embodiment of the present invention, the protrusions 71 of each clutch 70 are disposed on the lower part of the outer surface of clutch 70 as shown in FIG. 8. The teeth 61 are arranged to engage with the protrusions 71 when the padlock 10 is operated tin the locked mode as shown in FIG. 1B, and in the opened mode as shown in FIGS. 12B and 16B. After the shackle 40 is rotated away from its location in the opened position as shown in FIG. 12B so that the reset notch 43 is aligned with the reset slot 22/32 (see FIG. 1D, for example), the shackle 40 can be pushed downward along the spindle 50, the clutches 70 and the cylinder 80 until the pointer 82 of cylinder 80 reaches the end of the lower track 37 (see FIGS. 17A and 17B). As seen in FIG. 17B, the teeth 61 of each dial 60 are disengaged with the protrusions 71 of clutch 70 in the dial-clutch pair. Thus, the dials 60 can be rotated relative to the clutches 70 to change the combination code. However, the clutches 70 cannot rotate relative to the lock body 20/30 because each of the blocking edges 42 is located in the opening slot 22 of the corresponding clutch 70.

After the padlock 10 is reset, the shackle 40 can be pulled upward until the reset notch 43 is located outside the lock body 20/30. The shackle 40 can be rotated until the reset notch 43 is aligned with the passage slot 29/39 as shown in FIG. 1D, and then the shackle 40 can be pushed downward to change the padlock from the opened mode to the locked mode.

In summary, the padlock 10, according an embodiment of the present invention, is operable in a locked mode, an opened mode and a reset mode. The padlock has a shackle 40 having a longer leg or heel 42 and a shorter leg or toe 41. The padlock 10 has a lock body 20/30, the lock body 20/30 having a toe hole 21/31 on the first side of the lock body to receive the toe 41, a heel channel 22/32 dimensioned for placement of the heel 42, a cylinder hole 25/35 on the second side dimensioned to receive a cylinder 80. The padlock 10 also has a spindle 50 located inside the lock body 20/30, movable along a first direction substantially parallel to the heel channel 22/32, the spindle 50 connected to the heel 42 of the shackle 40 for movement together in the first direction; a plurality of clutches 70 arranged to form a clutch stack, each of the clutches 70 having an opening 74 dimensioned to receive the spindle 50; and a plurality of dials 60 engageable with the plurality of clutches 70 to form a combination code. The cylinder 80 is arranged for a key operation, the cylinder having a tip 81 arranged to contact the clutch stack when the padlock is operated in the locked mode, the opened mode and the reset mode. The cylinder 80 can be moved in the cylinder hole 25/35 along the first direction when the cylinder 80 is engaged with the spindle 50. The cylinder 80 can also be rotated relative to the spindle 50 by a key 120. The lock body 20/30 also has a body chamber 38/38 dimensioned for placement of the clutch stack. According to an embodiment of the present invention, the padlock can be unlocked to change from the locked mode to the opened mode by the combination code or by the key operation, and wherein, when the padlock 10 is unlocked by the combination code, the spindle 50 is engaged with the clutch stack for movement together along the first direction, and wherein, when the padlock 10 is unlocked by the key operation, the spindle 50 is disengaged from the clutch stack for movement in the first direction relative to the clutch stack.

What is claimed is:

1. A padlock operable in a locked mode, and an opened mode, said padlock comprising:

a shackle comprising a heel and a toe, a lock body comprising a first side, an opposing second side, a toe hole on the first side, the toe hole dimensioned to receive the toe, and a heel channel dimensioned for placement of the heel;

a spindle located inside the lock body, spaced from the heel channel, the spindle movable along a first direction substantially parallel to the heel channel, an extended member comprising a first member end fixedly connected to the spindle, and a second member end having a receiving hole dimensioned to receive the heel of the shackle, the extended member configured to link the spindle connected to and the heel of the shackle for movement together in the first direction relative to the lock body, wherein the shackle is rotatable relative to the extended member and the heel is movable in the heel channel along the first direction;

a plurality of clutches arranged to form a clutch stack, each of the clutches having an opening dimensioned to receive the spindle;

a plurality of dials engageable with the plurality of clutches to form a combination code; and a cylinder arranged for a key operation, the cylinder having a cylinder wall arranged to contact the clutch stack when the padlock is operated in the locked mode, and the opened mode, wherein the lock body further comprises a cylinder hole located on the second side of the lock body and a body chamber located near the cylinder hole, the cylinder hole dimensioned to receive the cylinder so as to allow the cylinder to move along the first direction, the body chamber dimensioned for placement of the clutch stack, and wherein the padlock can be unlocked to change from the locked mode to the opened mode by the combination code or by the key operation, and wherein, when the padlock is unlocked by the combination code, the spindle is engaged with the clutch stack for movement together along the first direction, and wherein, when the padlock is unlocked by the key operation, the spindle is disengaged from the clutch stack, allowing the spindle to move in the first direction relative to the clutch stack.

2. The padlock according to claim 1, wherein each of the dials is arranged to engage with a different one of the clutches to form a dial-clutch pair, and each of the clutches comprises a cylindrical surface and a plurality of protrusions around the cylindrical surface, and each of the dials comprises a plurality of teeth dimensioned to receive the protrusions of the clutch in the dial-clutch pair, wherein when the padlock is operated in the locked mode and in the opened mode, the teeth of the dial are arranged to engage with the protrusions of the clutch in the dial-clutch pair, preventing the dial from rotation relative to the clutch in the dial-clutch pair.

3. The padlock according to claim 2, wherein the body chamber comprises a plurality of blocking edges, each blocking edge corresponding to a different one of the clutches, and wherein each of the clutches further comprises an opening slot on the cylindrical surface, the opening slot dimensioned to receive the corresponding blocking edge, wherein when the opening slot is misaligned with the blocking edge, the clutch is prevented from moving in the first direction, and when the padlock is unlocked by the combination codes, the opening slot of each of the clutches is aligned with the corresponding blocking edge, allowing the clutch stack to move in the first direction along with the spindle to change the padlock from the unlocked mode to the opened mode.

4. The padlock according to claim 3, wherein the spindle comprises a first spindle end and an opposing second spindle end, the first spindle end adjacent to the first side of the lock body.

5. A padlock operable in a locked mode, an opened mode and a reset mode, said padlock comprising:

a shackle comprising a heel and a toe, a lock body comprising a first side, an opposing second side, a toe hole on the first side, the toe hole dimensioned to receive the toe, and a heel channel dimensioned for placement of the heel;

a spindle located inside the lock body, movable along a first direction substantially parallel to the heel channel, the spindle connected to the heel of the shackle for movement together in the first direction relative to the lock body;

a plurality of clutches arranged to form a clutch stack, each of the clutches having an opening dimensioned to receive the spindle;

a plurality of dials engageable with the plurality of clutches to form a combination code; and a cylinder arranged for a key operation, the cylinder having a cylinder wall arranged to contact the clutch stack when the padlock is operated in the locked mode and the opened mode, wherein the lock body further comprises a cylinder hole located on the second side of the lock body and a body chamber located near the cylinder hole, the cylinder hole dimensioned to receive the cylinder so as to allow the cylinder to move along the first direction, the body chamber dimensioned for placement of the clutch stack, and wherein the padlock can be unlocked to change from the locked mode to the opened mode by the combination code or by the key operation, and wherein, when the padlock is unlocked by the combination code, the spindle is engaged with the clutch stack for movement together along the first direction, and wherein, when the padlock is unlocked by the key operation, the spindle is disengaged from the clutch stack, allowing the spindle to move in the first direction relative to the clutch stack, wherein each of the dials is arranged to engage with a different one of the clutches to form a dial-clutch pair, and each of the clutches comprises a cylindrical surface and a plurality of protrusions around the cylindrical surface, and each of the dials comprises a plurality of teeth dimensioned to receive the protrusions of the clutch in the dial-clutch pair, wherein when the padlock is operated in the locked mode and in the opened mode, the teeth of the dial are arranged to engage with the protrusions of the clutch in the dial-clutch pair, preventing the dial from rotation relative to the clutch in the dial-clutch pair, wherein the body chamber comprises a plurality of blocking edges, each blocking edge corresponding to a different one of the clutches, and wherein each of the clutches further comprises an opening slot on the cylindrical surface, the opening slot dimensioned to receive the corresponding blocking edge, wherein when the opening slot is misaligned with the blocking edge, the clutch is prevented from moving in the first direction, and when the padlock is unlocked by the combination codes, the opening slot of each of the clutches is aligned with the corresponding blocking edge, allowing the clutch stack to move in the first direction along with the spindle to change the padlock from the unlocked mode to the opened mode, and wherein the spindle comprises a first spindle end and an opposing second spindle end, the first spindle end adjacent to the first side of the lock body, the spindle further comprising an extended member at the first spindle end, the extended member connected to the heel of the shackle for the movement together in the first direction, while allowing the heel to rotate in the heel channel relative to the extended member, and, wherein the spindle further comprises a spindle protrusion at the second spindle end, the spindle protrusion arranged to engage with the cylinder for causing the clutch stack to move together with the spindle and the cylinder in the first direction when the padlock is unlocked by the combination code, and when the padlock is unlocked by the key operation, the spindle protrusion is disengaged from the cylinder, allowing the spindle to move in the first direction relative to the clutch stack.

6. The padlock according to claim 4, wherein when the padlock is operated in the locked mode, the toe of the shackle is engaged with the toe hole of the lock body, preventing the heel of the shackle from rotating relative to the lock body, and when the spindle is moved in the first direction toward the first side of the lock body together with the heel of the shackle to change the padlock from the locked mode to the opened mode, the toe of the shackle is disengaged from the toe hole of the lock body, allowing the shackle to rotate relative to the lock body.

7. A padlock operable in a locked mode, an opened mode and a reset mode, said padlock comprising:

a shackle comprising a heel and a toe, a lock body comprising a first side, an opposing second side, a toe hole on the first side, the toe hole dimensioned to receive the toe, and a heel channel dimensioned for placement of the heel;

a spindle located inside the lock body, movable along a first direction substantially parallel to the heel channel, the spindle connected to the heel of the shackle for movement together in the first direction relative to the lock body;

a plurality of clutches arranged to form a clutch stack, each of the clutches having an opening dimensioned to receive the spindle;

a plurality of dials engageable with the plurality of clutches to form a combination code; and a cylinder arranged for a key operation, the cylinder having a cylinder wall arranged to contact the clutch stack when the padlock is operated in the locked mode and the opened mode, wherein the lock body further comprises a cylinder hole located on the second side of the lock body and a body chamber located near the cylinder hole, the cylinder hole dimensioned to receive the cylinder so as to allow the cylinder to move along the first direction, the body chamber dimensioned for placement of the clutch stack, and wherein the padlock can be unlocked to change from the locked mode to the opened mode by the combination code or by the key operation, and wherein, when the padlock is unlocked by the combination code, the spindle is engaged with the clutch stack for movement together along the first direction, and wherein, when the padlock is unlocked by the key operation, the spindle is disengaged from the clutch stack, allowing the spindle to move in the first direction relative to the clutch stack, wherein each of the dials is arranged to engage with a different one of the clutches to form a dial-clutch pair, and each of the clutches comprises a cylindrical surface and a plurality of protrusions around the cylindrical surface, and each of the dials comprises a plurality of teeth dimensioned to receive the protrusions of the clutch in the dial-clutch pair, wherein when the padlock is operated in the locked mode and in the opened mode, the teeth of the dial are arranged to engage with the protrusions of the clutch in the dial-clutch pair, preventing the dial from rotation relative to the clutch in the dial-clutch pair, wherein the body chamber comprises a plurality of blocking edges, each blocking edge corresponding to a different one of the clutches, and wherein each of the clutches further comprises an opening slot on the cylindrical surface, the opening slot dimensioned to receive the corresponding blocking edge, wherein when the opening slot is misaligned with the blocking edge, the clutch is prevented from moving in the first direction, and when the padlock is unlocked by the combination codes, the opening slot of each of the clutches is aligned with the corresponding blocking edge, allowing the clutch stack to move in the first direction along with the spindle to change the padlock from the unlocked mode to the opened mode, and wherein the spindle comprises a first spindle end and an opposing second spindle end, the first spindle end adjacent to the first side of the lock body, the spindle further comprising an extended member at the first spindle end, the extended member connected to the heel of the shackle for the movement together in the first direction, while allowing the heel to rotate in the heel channel relative to the extended member, and wherein when the padlock is operated in the locked mode, the toe of the shackle is engaged with the toe hole of the lock body, preventing the heel of the shackle from rotating relative to the lock body, and when the spindle is moved in the first direction toward the first side of the lock body together with the heel of the shackle to change the padlock from the locked mode to the opened mode, the toe of the shackle is disengaged from the toe hole of the lock body, allowing the shackle to rotate relative to the lock body, wherein the heel channel comprises a passage slot and a reset slot on the first side of the lock body, and the heel of the shackle comprises a reset notch located near the first side of the lock body, wherein when the padlock is operated in the locked mode, the reset notch is located inside the lock body between the passage slot and the extended member of the spindle, and when the padlock is unlocked by the combination code or by the key operation, the heel of the shackle can be caused to move in the first direction and the reset notch is moved through the passage slot to locate outside the lock body to change the padlock from the locked mode to the opened mode.

8. The padlock according to claim 7, wherein when the padlock is operated in the opened mode and the reset notch of the heel is aligned with the passage slot of the heel channel, the shackle can be caused to move in a second direction opposite to the first direction to engage the toe of the shackle with the toe hole for changing the padlock from the opened mode to the locked mode.

9. The padlock according to claim 7, wherein the cylindrical surface of each of the clutches has a surface portion for disposing the plurality of protrusions, wherein when the padlock is operated in the locked mode and in the opened mode, each of the dials is located adjacent to the surface portion of the clutch in the dial-clutch pair and the teeth of each of the dials are engaged with the protrusions of the clutch in the dial-clutch pair, and wherein when the padlock is operated in the opened mode and the shackle has been rotated to cause the reset notch on the heel to align with the reset slot of the heel channel, the shackle can be caused to move together with the spindle, the clutch stack and the cylinder in a second direction opposite to the first direction for relocating each of the dials away from the surface portion of the clutch in the dial-clutch pair so as to disengage the teeth from the protrusions in the dial-clutch pair.

10. The padlock according to claim 9, wherein when the teeth of the dial in each of the dial-clutch pairs is disengaged with the protrusion of the clutch in each of the dial-clutch pairs, the dial can be rotated relative to the clutch in the dial-clutch pair for changing the combination code.

11. The padlock according to claim 5, wherein the cylinder comprises a first cylinder end and an opposing second cylinder end, the second cylinder located near the second side of the lock body, the first cylinder end comprising the cylinder wall and a tip extended from the cylinder wall, the tip arranged to engage with the spindle protrusion when the padlock is operated in the locked mode, wherein the cylinder further comprises a key slot at the second cylinder end, the key slot dimensioned to receive a key to rotate the cylinder in the cylinder hole relative to the lock body so as to disengage the tip from the spindle to unlock the padlock by the key operation.

12. The padlock according to claim 11, wherein the cylinder further comprises a pointer and the cylinder hole comprises an edge-groove arranged to receive the pointer for rotation therein when the cylinder is caused to rotate relative to the lock body.

13. The padlock according to claim 12, wherein the cylinder hole further comprises a track in communication with the edge-groove, the track arranged to receive the pointer when the cylinder is caused to move in the first direction along with the spindle when the padlock is unlocked by the combination code to change the padlock from the locked mode to the opened mode and wherein when the pointer is located in the track, the cylinder is prevented from rotation relative to the lock body.

14. The padlock according to claim 13, further comprising a latch and an indicator member, the latch having a latch opening and a latch fork adjacent to the latch opening, the indicator member having an indicator end and a cutout section positioned in relationship to the latch, and the lock body further comprises a latch slot and an indicator chamber, the latch slot made in the cylinder hole, the indicator chamber dimensioned for placement of the indicator member, the indicator chamber having a chamber hole extended to the second side of the lock body, wherein when the padlock is operated in the locked mode, the cutout section of the latch is located in the latch fork, preventing the indicator end from moving outside the lock body through the chamber hole.

15. The padlock according to claim 14, wherein when the cylinder is caused to rotate relative to the lock body to unlock the padlock by the key operation, the pointer is arranged to move the latch toward the indicator member, causing the cutout section of the indicator member to move out of the latch fork into the latch opening, wherein when the cutout section of the indicator member is moved out of the latch fork into the latch opening, the indicator end of the indicator member is allowed to move outside the lock body through the chamber hole.

* * * * *